US011641908B2

(12) United States Patent
Engel et al.

(10) Patent No.: US 11,641,908 B2
(45) Date of Patent: May 9, 2023

(54) ARTICLE OF FOOTWEAR WITH STRETCHABLE UPPER

(71) Applicant: Converse Inc., Boston, MA (US)

(72) Inventors: Gavin Dean Engel, Boston, MA (US); Zhiqiang Li, Andover, MA (US); Richa Maheshwari, Boston, MA (US)

(73) Assignee: Converse Inc., Boston, MA (US)

( * ) Notice: Subject to any disclaimer, the term of this patent is extended or adjusted under 35 U.S.C. 154(b) by 284 days.

(21) Appl. No.: 16/683,577

(22) Filed: Nov. 14, 2019

(65) Prior Publication Data

US 2021/0145123 A1 May 20, 2021

(51) Int. Cl.
*A43B 23/02* (2006.01)
*A43B 9/02* (2006.01)

(52) U.S. Cl.
CPC ..... *A43B 23/027* (2013.01); *A43B 23/025* (2013.01); *A43B 23/0235* (2013.01); *A43B 9/02* (2013.01)

(58) Field of Classification Search
CPC ..... A43B 23/027; D05B 93/00
USPC ..... 112/422–426, 433, 436, 440, 441
See application file for complete search history.

(56) References Cited

U.S. PATENT DOCUMENTS 2,097,810 A * 11/1937 Dawes ..... A43C 11/002 139/421
2,184,082 A 12/1939 Roberts
2,184,261 A 12/1939 Vamos
2,188,168 A 1/1940 Winkel
2,240,816 A 5/1941 Tweedie
2,274,085 A 2/1942 Mitulski
2,298,941 A 10/1942 Herrmann
2,330,459 A 9/1943 Tweedie
2,356,268 A 8/1944 Phillips
2,421,604 A * 6/1947 Eaton ..... A43B 23/14 36/57
2,679,117 A 5/1954 Reed
3,803,731 A 4/1974 Zumbro
4,366,634 A * 1/1983 Giese ..... A43B 5/00 36/114

(Continued)

FOREIGN PATENT DOCUMENTS

CN 206986458 U 2/2018
EP 0123857 A2 * 11/1984 ..... A43B 9/00

(Continued)

OTHER PUBLICATIONS

I-Chin D. Tsai et al., The influence of woven stretch fabric properties on garment design and pattern construction, 2002, Institute of Measurement and Control, vol. 24 issue 1, pp. 3-14. (Year: 2002).*

(Continued)

*Primary Examiner* — Sharon M Prange
*Assistant Examiner* — Grady Alexander Nunnery
(74) *Attorney, Agent, or Firm* — Banner & Witcoff, Ltd.

(57) ABSTRACT

An article of footwear may include a sole assembly and an upper, positioned above the sole assembly, formed from a stretchable material such as a stretchable canvas. The upper may include stitching, with a stretchability of the stretchable canvas being maintained in an area of the upper where the stitching extends. The stitching may include, for example, double needle cover stitching.

7 Claims, 7 Drawing Sheets

(56) References Cited

U.S. PATENT DOCUMENTS

| | | | | |
|---|---|---|---|---|
| 5,784,806 | A * | 7/1998 | Wendt | A43B 3/02 36/51 |
| 6,785,983 | B2 | 9/2004 | Challe | |
| 10,472,741 | B2 * | 11/2019 | Zeyrek | D03D 15/56 |
| 2009/0107012 | A1 * | 4/2009 | Cheney | A43B 23/027 36/25 R |
| 2009/0272009 | A1 | 11/2009 | Weisner et al. | |
| 2012/0204448 | A1 | 8/2012 | Bracken | |
| 2013/0104420 | A1 * | 5/2013 | Heathcote | A43B 5/12 36/102 |
| 2014/0352170 | A1 | 12/2014 | Heathcote | |
| 2017/0044695 | A1 * | 2/2017 | Hays | D04B 1/24 |
| 2018/0064210 | A1 * | 3/2018 | Turner | A43C 11/002 |
| 2018/0368500 | A1 * | 12/2018 | Pollock | A41H 9/00 |

FOREIGN PATENT DOCUMENTS

| | | | |
|---|---|---|---|
| JP | S5336341 | A | 4/1978 |
| JP | 2009125527 | A * | 6/2009 |

OTHER PUBLICATIONS

Feb. 19, 2021—(WO) ISR—PCT/US20/06208.

Stitch Guide, Most Common Stitch Types in ASTM D-6193 and ISO 4915:1991 Standards, Second Edition, Jun. 3, 2008; Retrieved from the Internet: <http://www.texup.eu/StitchGuide.pdf> [retrieved on Aug. 21, 2019].

Industrial Sewing Machines; Retrieved from the Internet: <https://www.slideshare.net/AmitDas125/industrial-sewing-machines> [retrieved on Aug. 18, 2019].

Juki, MCS-1500 Instruction Manual, 3-Needle, 2/3/4-Thread Cover Stitch Sewing Machine; Retrieved from the Internet: <https://www.juki.co.jp/household_en/serger/pdf/MCS-1500_manual.pdf> [retrieved on Aug. 18, 2019].

Mazadul Hasan Sheshir: "Stitch Types", Southeast University, Department of Textile Engineering; Retrieved from the Internet: ,https://www.slideshare.net/sheshir/stitch-n-sesm-types-with-description. [retrieved on Aug. 18, 2019].

* cited by examiner

ARTICLE OF FOOTWEAR WITH STRETCHABLE UPPER

BACKGROUND

Conventional articles of athletic footwear such as shoes may include an upper and a sole assembly. The upper may provide a covering to receive and securely position a foot with respect to the sole assembly. In addition, the upper may have a configuration that protects the foot and provides ventilation, thereby cooling the foot and removing perspiration. Footwear uppers may be formed of various materials, including canvas, for example. The sole assembly may be secured to a lower portion of the upper and may, when the footwear is worn, be generally positioned between the ground and the wearer's foot. In addition to attenuating ground reaction forces, the sole assembly may provide traction, control foot motions (e.g., by resisting over pronation), and impart stability, for example. An insole may be located within the upper and adjacent to a plantar (i.e., lower) surface of the foot to enhance footwear comfort, and is typically a thin, compressible member. Various materials may be used in footwear uppers and in sole structures.

Figure 1:
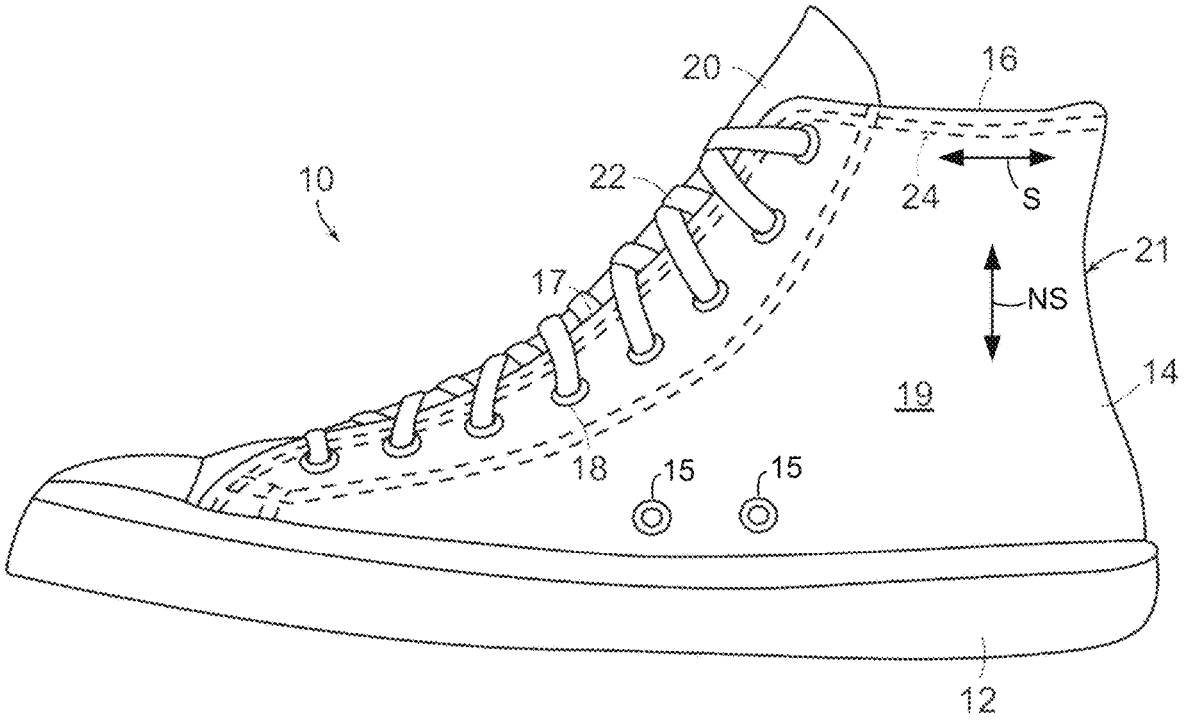
FIG. 1 is a side view of an article of footwear.

The figures referred to above, which are not drawn necessarily to scale, are merely conceptual in nature and intended to show one or more features of one or more examples of the disclosure. Some features shown in the drawings may be enlarged and/or distorted, relative to other features, to facilitate explanation and understanding. The same reference numbers are used in the drawings for similar or identical components and features. Additional examples of articles (e.g., articles of footwear) according to the disclosure may have some or all of the features shown in the drawings, and/or may include additional features. The configurations and components of such examples may be determined, in part, by the intended application and environment in which they are to be used.

DETAILED DESCRIPTION

Products that are successful in the marketplace, particularly consumer products, may have both functional and aesthetic characteristics. Over time, however, the aesthetic characteristics of a product may take on an importance that may interfere with a manufacturer's ability to improve the functional characteristics of that product. In particular, consumers of a product may become accustomed to one or more aspects of that product's appearance as that product remains on the market for longer and longer periods of time. Consumers may associate that appearance with a product or source, and/or may wish to purchase that product based on such association. Consumers may also or alternatively simply find those aesthetic features of the product to be visually appealing. If well-known aesthetic features of a product are changed, consumers may refuse to continue purchasing that product. As a result, a manufacturer of that product may have difficulty incorporating a functional improvement if a product change associated with that functional improvement will interfere with an established appearance that buyers have come to associate with the product.

These problems may occur in connection with footwear. For example, Converse Chuck Taylor All Star® footwear is a line of products that have been continuously on sale for many years, and that have numerous appearance features that have become iconic. Consumers expect—and demand—these appearance features. If these appearance features are changed too much, consumers may simply buy some other shoe.

One such appearance feature of Converse Chuck Taylor All Star® footwear relates to stitching. Traditionally, certain types of Converse Chuck Taylor All Star® footwear have included uppers formed from canvas. Those canvas uppers include parallel lines of stitching along the upper, proximate the collar and the throat of the upper, that helps secure an outer panel of the upper to a lining of the upper. This stitching is, along with other appearance features, an important component of the overall look of the product. If the appearance of this stitching were to change, the shoe would simply not look the same.

The parallel stitching lines in traditionally-manufactured Converse Chuck Taylor All Star® footwear are formed using a double needle straight lock stitch. That type of stitch does not elongate or stretch. Because the canvas used for uppers of those traditionally-manufactured products also does not stretch, this has not previously been a concern. However, stretchable canvas materials that have an appearance similar to the non-stretchable canvas used for traditionally-manufactured products are available. Incorporating such stretchable canvas into uppers of Converse Chuck Taylor All Star® footwear would offer multiple functional advantages such as improved fit and greater wearer comfort. However, the benefits of replacing the canvas used in those uppers would be reduced (if not lost) if straight lock stitches are used for the parallel stitching lines. Because straight lock stitching does not stretch, use of straight lock stitching would drastically reduce (if not eliminate) the stretchability of the stretch canvas along that straight lock stitching (e.g., along edges of the ankle collar and throat).

Other stitch types do allow elongation. However, many of those stitch types have a very different appearance, and as mentioned, many devoted consumers of the Chuck Taylor All Star® shoe demand fidelity to its traditional appearance, even in the details. One stitch type that allows elongation, and that also has an appearance similar to double needle straight lock stitching on one side, is a double needle cover stitch. As explained in further detail below, a double needle cover stitch may be formed using two needle threads and a loop thread. The two needle threads may be arranged as parallel lines of regularly spaced loops that penetrate joined materials, and that have an outward appearance similar to straight lock stitching. The loop thread, which is located on an opposite side of the material, interloops and interlaces the loops of the needle threads in a pattern that allows the stitch to elongate along the length of the stitch.

The double needle cover stitch is not known to have previously been used in connection with shoes. Indeed, and despite inquiries among various high-volume footwear manufacturers, the inventors were unable to find a footwear manufacturer having equipment in its factory that was even capable of performing cover stitching in connection with a shoe upper. Ultimately, it was necessary to work with stitching machine vendors to obtain equipment that could produce double needle cover stitching. A footwear manufacturer then had to integrate that equipment into a process for making uppers.

Double needle cover stitching has been used in garment applications such as hems around arm or leg openings. Forces on such a hem are different than those found in the ankle and/or throat of an upper. A garment hem line may be tensioned somewhat (e.g., around a sleeve opening of a tightly fitting t-shirt) and may be subject to some abrasion against a wearer's skin or other garment. In a shoe, however, such forces would normally be greater in magnitude and/or sustained over a much longer period. For example, a shoe wearer may secure a shoe by tightly cinching laces, thereby imparting tension along the edges of the upper in the ankle opening and/or throat region. As the shoe wearer walks, runs, etc., the tension along the ankle collar and/or throat regions would be increased. Users or manufacturers have sought to provide elastic tensioning to footwear by replacing standard laces with laces that have elastic properties, enabling limited lace elongation. However, the stitching of shoe uppers, particularly around the collars, has typically been selected for secure, durable, immobile connection of shoe materials.

FIG. 1 is a medial side view of an example shoe 10 having an upper comprising stretchable canvas, and in which double needle cover stitching is used. The shoe 10 may include a sole assembly 12 and an upper 14 positioned above and secured to the sole assembly 12. The upper 14 may comprise a collar 16 that extends along a top edge of the upper 14, and that forms an opening through which a wearer's foot may be inserted into the interior of the shoe 10. The collar 16 may connect to a throat 17. A pair of rows of eyelets 18 may be positioned on the upper 14 under edges of the throat 17. A tongue 20 may span the throat 17. A lace 22 may be threaded through the eyelets 18 on the medial side 19 of the throat 17 and through similar eyelets 18, not shown, on a lateral side of the throat 17. The upper 14 may also include ventilation openings 15. The sole assembly 12 may include a midsole positioned beneath and secured to the upper 14, and an outsole may be secured to a bottom surface of the midsole. Also or alternatively, a bottom surface of a midsole can serve as the ground-engaging portion (or other contact surface-engaging portion) of the shoe 10. Sole assembly 12 may be secured to the upper 14 by, e.g., gluing or other known techniques.

The upper 14 may be comprise a stretchable canvas material. Stretchable canvas used for the upper 14 may be formed from various materials and may have various properties. For example, an outer layer of the upper 14 may comprise an example stretchable canvas that is a stretchable canvas material having a fiber content of approximately 73% cotton, approximately 15% nylon, and approximately 12% spandex, and a weight of approximately 451.5 grams per square meter (g/m2). The example stretchable canvas may be a plain weave in which weft and warp threads cross at right angles, and which may have an appearance that emulates traditional non-stretch canvas materials used in previous shoes. The example stretchable canvas may include yarns or fibers extending in weft and warp directions and may have a weft direction stretchability that is greater than a warp direction stretchability.

Stretchability of material in a particular direction may be the degree to which that material is elastically elongatable in that direction. Stretchability (or elastic elongatability) in a particular direction may be quantified as a percentage of an original length (in that direction) by which a material will extend without breaking when tension is applied, and from which extension the material will return to the original length after tension is released. The example stretchable canvas may have a weft direction stretchability percentage of between 120% and 170% and a warp direction stretchability percentage between 20% and 35%. The warp direction stretchability percentage may also or alternatively be expressed as a percentage of the weft direction stretchability percentage (e.g., if weft direction stretchability percentage is X % and warp direction stretchability percentage is Y %, warp direction stretchability percentage may be Y/X % of the weft direction stretchability percentage). The example stretchable canvas may have a warp direction stretchability percentage that is between 12% and 29% of the weft direction stretchability percentage. As another example, a stretchable canvas may have a weft direction stretchability percentage up to 138% and/or a warp direction stretchability percentage between 5% and 10%.

The term "approximately" means close to, or about a particular value, within the constraints of sensible commercial engineering objectives, costs, manufacturing tolerances, and capabilities in the field of footwear manufacturing and use. The term "substantially" means mostly, or almost the same as, within the constraints of sensible commercial engineering objectives, costs, manufacturing tolerances, and capabilities in the field of footwear manufacturing and use.

Stretchable canvas material may be elastically elongatable so as to stretch from an at rest condition to a fully stretched condition and then restore itself to the at rest condition. Including stretchable canvas material in the upper 14 may improve flexibility, comfort, and easy on/off wearability of the shoe 10. For example, when the lace 22 is threaded through all of the eyelets 18 and tied, a wearer may still be able to don or remove the footwear 10 without untying the lace 22.

The upper 14 may include stitching 24 to secure layers of the upper 14 to one another. In particular, and as described in more detail in connection with FIGS. 4A and 4B, the stitching 24 may help secure a stretch canvas outer layer of the upper 14 to an inner lining layer. The stitching 24 may extend along the upper 14 adjacent (or proximate) to the collar 16 and the throat 17, and may extend substantially parallel to the edges of the collar 16 and the throat 17 (e.g., by following, at an approximately constant offset, the edges of the collar 16 and the throat 17). A portion of the stitching 24 may also extend under the eyelets 18. The stitching 24 may extend over the lateral side of the upper 14 in a pattern similar to that shown in FIG. 1 for the medial side. The stretch canvas material of the upper 14 may be oriented so that the weft direction is approximately parallel to the edge of the collar 16, and so that the maximum stretchability of the canvas material is in a direction S in the heel region 21 and near collar 16. The direction of no (or minimum) stretchability may extend in a direction NS. The stitching 24 may also be included in other regions, and/or may be omitted from one or more of the regions indicated above.

Figure 2:
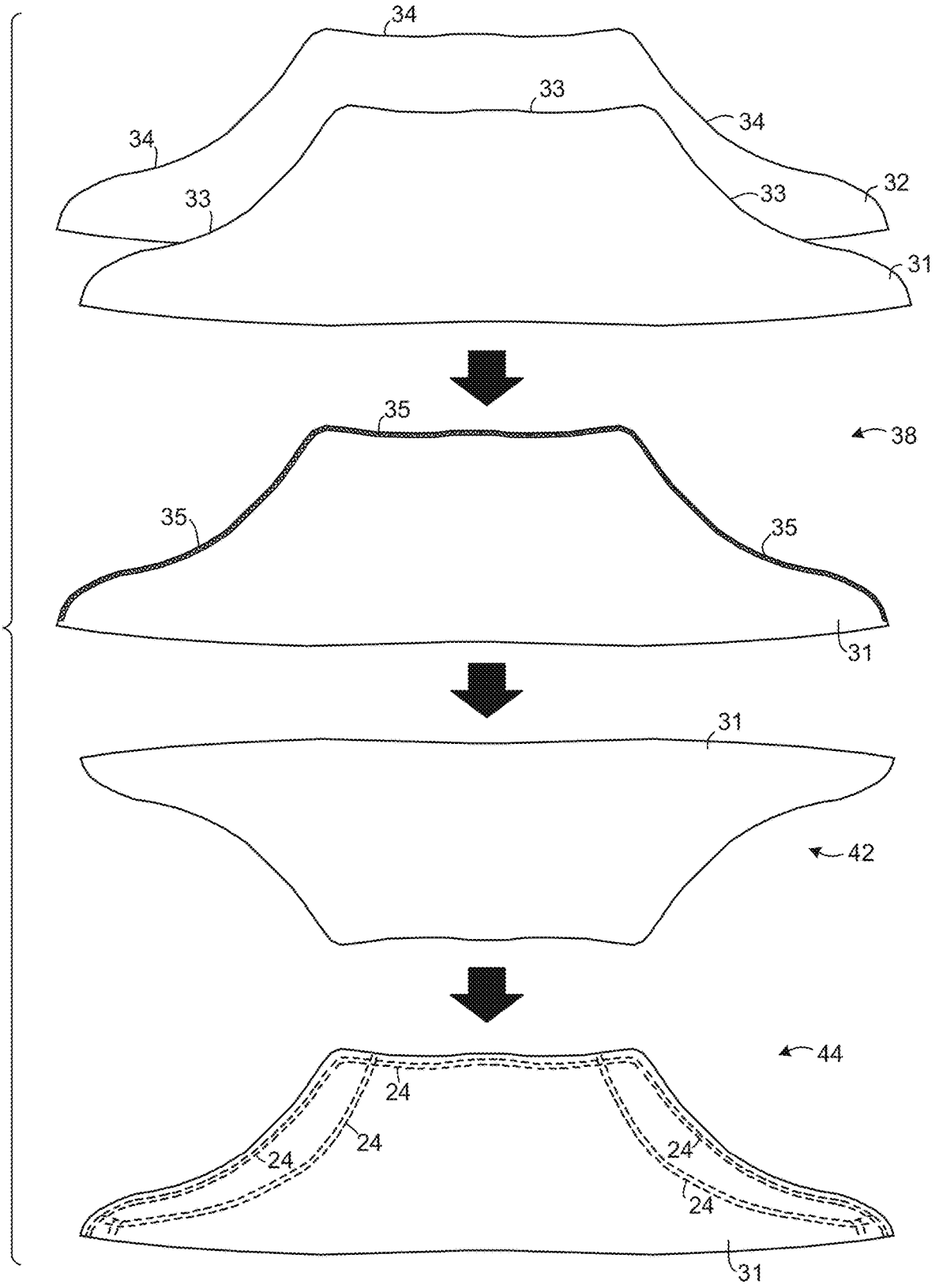
FIG. 2 shows components of an upper, for the article of footwear of FIG. 1, at various stages during a process for forming the upper.

FIG. 2 shows components at several stages during an example process for fabricating the upper 14. As part of that process, and as shown at the top of FIG. 2, a panel 31 of stretchable canvas and a panel 32 of a liner material may be cut from larger sheets. The shapes of the panels 31 and 32 may correspond to a slightly enlarged and flattened version of the portion of the upper 14 extending from the medial edge of the throat 17, around the heel, and to the lateral edge of the throat 17. However, the term "panel" is not limited to particular shape. A panel may, for example, comprise (or consist of) a portion of material (e.g., a ribbon, strip, tape, etc.) with a length that is much greater than its width.

Examples of materials that may be used for the liner material include stretch canvas and stretch knits. The liner material may be more stretchable in one direction than another, or may have a stretchability that is approximately the same in all directions. If a liner material has a direction of maximum stretchability, the panel 32 and the panel 31 may be cut from larger sheets of materials such that, when the panels 31 and 32 are aligned as shown in FIG. 2, the directions of maximum stretchability in the two panels are aligned. The liner material may have a maximum stretchability that is equal to or greater than a maximum stretchability of the canvas material. The liner material may have a maximum stretchability that is less than a maximum stretchability of the canvas material, but that allows stretch of the upper in regions joined by any of the various types of stretchable stitches described herein. If two materials having different maximum stretchabilities are joined with their directions of maximum stretchability aligned, and are joined by a stitch (e.g., as described herein) that extends along both directions of maximum stretchability and that does not limit stretchability, the maximum stretchability of the joined materials along that stitch may be the lesser of the maximum stretchabilities of the two materials. For the joined materials however, greater force may be needed to achieve maximum stretch.

Figure 3A:
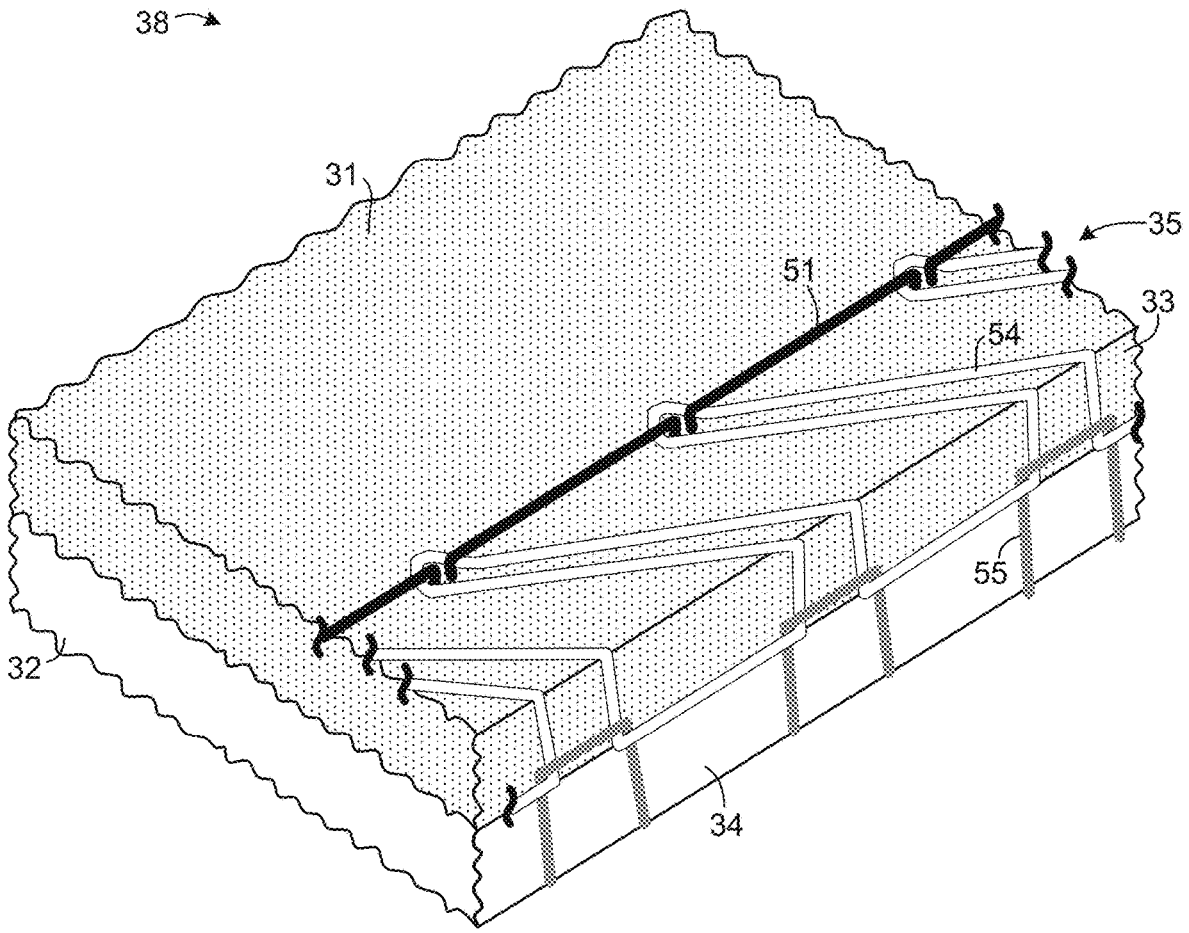
FIG. 3A is an enlarged, partially-schematic perspective view of a portion of components of an upper of the article of footwear of FIG. 1.
Figure 3B:
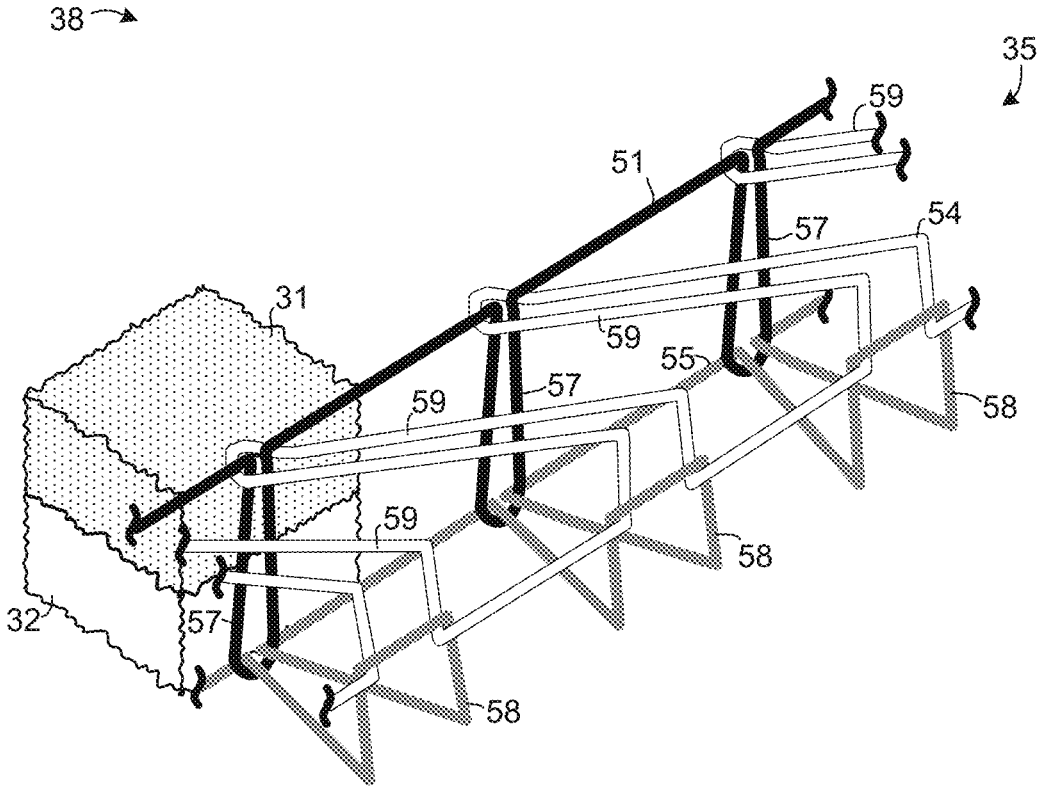
FIG. 3B is an enlarged, partially-schematic perspective view of the portion of components from FIG. 3A, but with additional portions of material panels omitted to show stitch structure.

A top edge 33 of the panel 31 and a top edge 34 of the panel 32 may be sewn together, using stitching 35, to create a first partial shell 38. The stitching 35 may, for example, comprise overlock stitching. Additional details of the stitching 35 are shown in FIGS. 3A and 3B and are described more fully below. When the panels 31 and 32 are sewn along the edges 33 and 34 to form the first partial shell 38, the right side of the panel 31 (i.e., the side that fill face outward in the completed shoe 10) and the right side of the panel 32 (i.e., the side that will face toward the interior of the completed shoe 10) are facing each other. The first partial shell 38 may be turned right side out to create a second partial shell 42. In the second partial shell 42, the edges 33 and 34 joined by the stitching 35 are hidden inside and between unjoined portions of the panels 31 and 32.

Figure 4A:
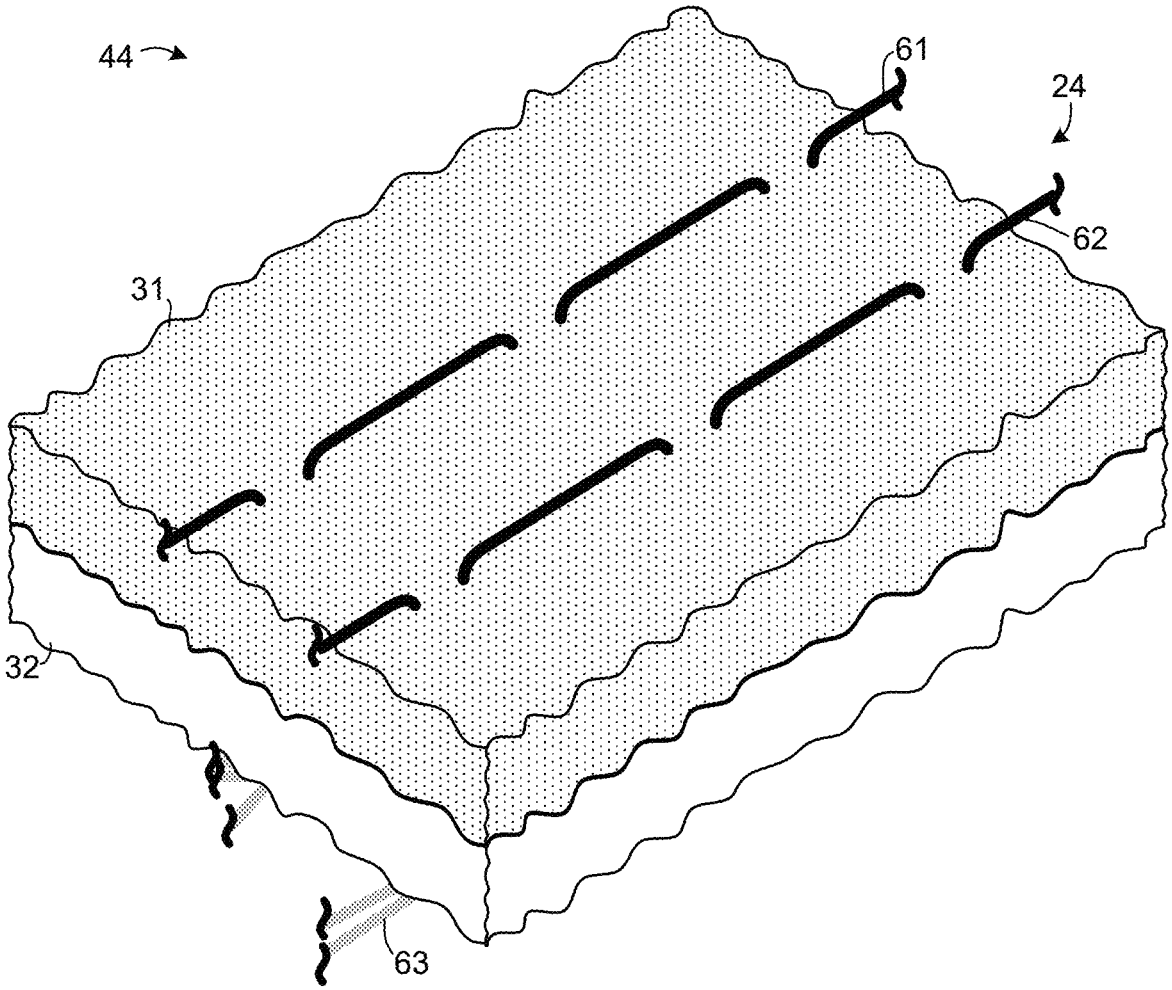
FIG. 4A is another enlarged, partially-schematic perspective view of a portion of components of an upper of the article of footwear of FIG. 1.
Figure 4B:
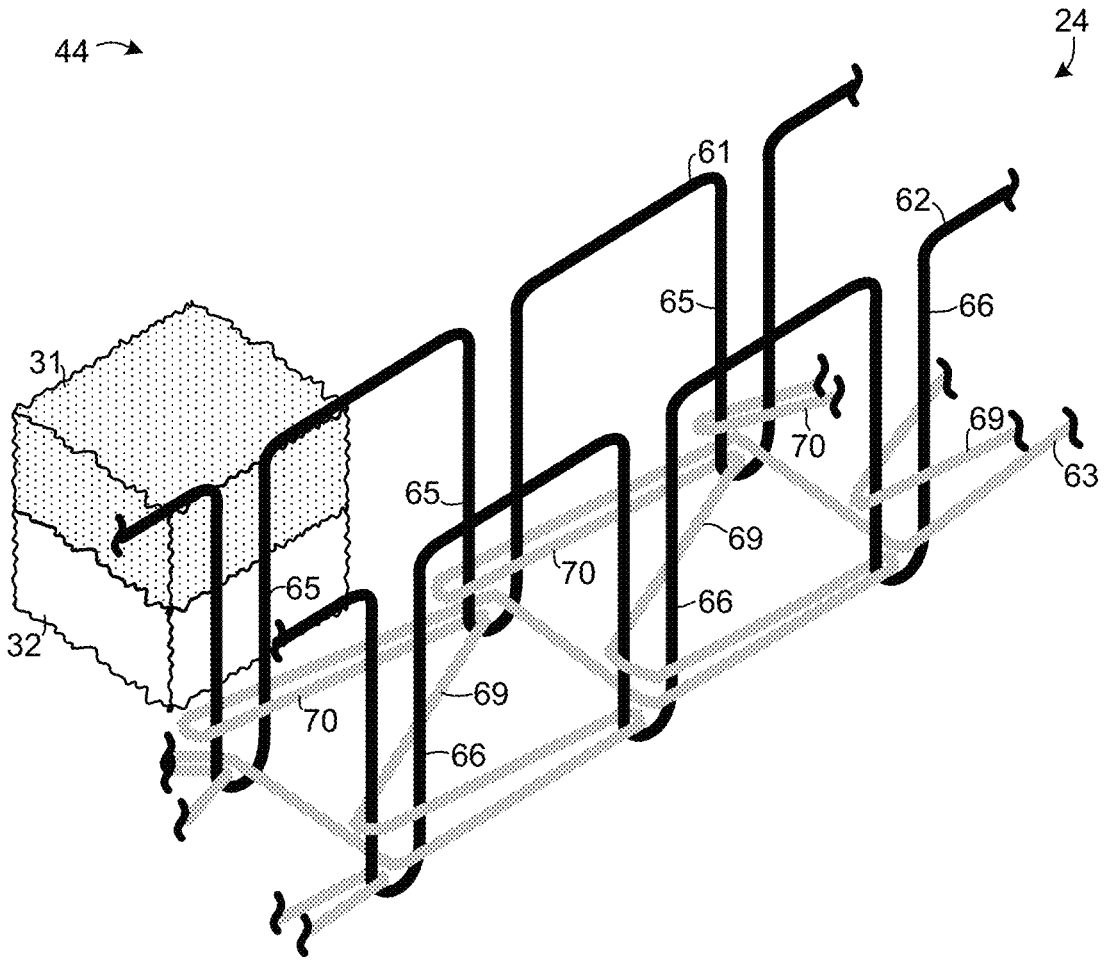
FIG. 4B is an enlarged, partially-schematic perspective view of the portion of components from FIG. 4A, but with additional portions of material panels omitted to show stitch structure.

The stitching 24 may then be applied to the second partial shell 42 to create a third partial shell 44. The third partial shell 44 shown in FIG. 2 has been rotated 180 degrees, in the plane of the figure, relative to the second partial shell 42. Additional details of the stitching 24 are shown in FIGS. 4A and 4B and are described more fully below. Fabrication of the upper 14 may be completed by performing additional steps. For example, the eyelets 18 and ventilation holes may be installed, a toe piece and the tongue 20 may be attached, an Achilles region reinforcing strip may be added, a strobel or other lasting element may be attached, etc. The upper 14 may then be attached to the sole structure 12 to fabricate the shoe 10.

FIG. 3A is an enlarged, partially-schematic perspective view of a portion of the first partial shell 38 that includes a section of the stitching 35. The remainder of the stitching 35 may be similar. In FIGS. 3A through 4B, the panel 31 of stretchable canvas is represented with stippling, and the panel 32 of liner material is shown without a pattern, to more clearly distinguish the separate materials. This way of showing the panels 31 and 32 is not intended to require (or exclude) a difference in color, in other appearance-related features, or in other material properties of the two materials used for the panels. The wavy lines along edges of the sections of the panels 31 and 32 shown in FIGS. 3A through 4B indicate that the panels extend beyond the direction of the wavy-line edges. Shading and outline used for threads in FIGS. 3A through 4B is used merely to distinguish between threads and better show relative positions, and is not intended to require (or exclude) a difference in color, in other appearance-related features, or in other material properties of the threads. Vertical or angled tilde ("~") symbols are used to indicate that the threads, described below, continue beyond the regions shown.

As indicated above, the stitching 35 may be an overlock stitch (also known as an over edge stitch). Although a three-thread overlock stitch (e.g., an ASTM D-6193 type 504 stitch) is shown in the example of FIGS. 3A and 3B, other types of overlock stitches may be used. Those other stitch types include, without limitation, a four-thread overlock stitch (e.g., an ASTM D-6193 type 512 or type 514 stitch) or a five-thread overlock stitch (e.g., an ASTM D-6193 type 516 stitch). Types of stitches, other than overlock stitches, allowing extension along the stitch line may also or alternatively be used. Multiple types of stitches may be combined for the stitching 35 (e.g., one stitch type in a first section, a different stitch type in second section). Although the example of FIG. 3A shows the needle thread 51 of the stitching 35 running along the panel 31, the stitching 35 could be applied in the reverse manner. For example, the positions of the panels 31 and 32 may be reversed from what is shown in FIG. 3A.

The stitching 35 comprises three threads: a needle thread 51 and two looper threads 54 and 55. The needle thread 51 may extend over the surface the panel 31 along a path parallel to the edges 33 and 34 of the panels 31 and 32, with loops of the thread 52 penetrating the panels 31 and 32 at regular intervals. The threads 54 and 55 may extend over the edges 33 and 34. In the completed upper 14 the structure of the stitching 35, and of the portions of the panels 31 and 32 extending from the thread 51 to the edges 33 and 34, may be substantially the same throughout as is shown in FIG. 3A. In the completed upper 14, however, the panel 31 is folded over the portion of the panel 31 secured by the stitching 35, and the panel 32 is folded over the portion of the panel 32 secured by the stitching 35. The stitching 35 may allow the panels 31 and 32 to stretch, in the regions joined by the stitching 35, to the same extent that those panel regions may be able to stretch before the stitching 35 is applied.

FIG. 3B is an enlarged, partially-schematic perspective view of the portion of the first partial shell 38 shown in FIG. 3A, but with additional portions of the panels 31 and 32 omitted to show additional structure of the stitching 35. Each of loops 57 of the thread 51 penetrates the panels 31 and 32. Each of loops 58 of the thread 55 passes through the bottom portion of one of the loops 57 and extends across the surface of the panel 32 and over the edge 34. Each of loops 59 of the thread 55 passes through one of the loops 58, extends over the edge 33 and across the surface of the panel 31, interloops one of the loops 57. Moreover, the loop 58 through which each of the loops 59 extends passes through one of the loops 57 that is different from (but adjacent to) the loop 57 interlooped by that loop 59.

FIG. 4A is an enlarged, partially-schematic perspective view of a portion of the third partial shell 44 that includes a section of the stitching 24. The remainder of the stitching 24 may be similar. As indicated above, the stitching 24 may be a double needle cover stitch (e.g., an ASTM D-6193 type 406 stitch). Other types of cover stitches could be used. For example, a three-needle cover stitch (e.g., an ASTM D-6193 type 407 stitch) could be used, with the center needle thread having a color similar to the color of the outer surface of the panel 31, so as to have an external appearance similar to that shown in FIGS. 1 and 2. Multiple types of stitches may be combined for the stitching 24 (e.g., one stitch type in a first section, a different stitch type in second section).

The stitching 24 comprises three threads: two needles threads 61 and 62 and one looper thread 63. The needle threads 61 and 62 may extend over the surface of the panel 31 in parallel paths, with loops of the threads 61 and 62 penetrating the panels 31 and 32 at regular intervals. As partially seen in FIG. 3A, the looper thread 63 extends across the surface of the panel 32. In the completed upper 14 the structure of the stitching 24, and of surrounding portions of the panels 31 and 32 joined by the stitching 24, may be substantially the same throughout as is shown in FIG. 4A. The stitching 24 may also allow the panels 31 and 32 to stretch, in the regions joined by the stitching 24, to the same extent that those panel regions may be able to stretch before the stitching 24 is applied.

FIG. 4B is an enlarged, partially-schematic perspective view of the portion of the third partial shell 44 shown in FIG. 4A, but with additional portions of the panels 31 and 32 omitted to show additional structure of the stitching 24. Each of loops 65 of the thread 61, and each of loops 66 of the thread 62, penetrates the panels 31 and 32. For each pair of adjacent loops 65 and 66, a portion of the thread 63 passes through. That portion of the thread 63 forms loops 69 and 70. The loop 69, between the pair of adjacent loops 65 and 66, interloops a loop 66 of the next pair of loops 65 and 66. The loop 70 passes through the loop 65 and then interloops the loop 65 of the next pair of loops 65 and 66.

Figure 5:
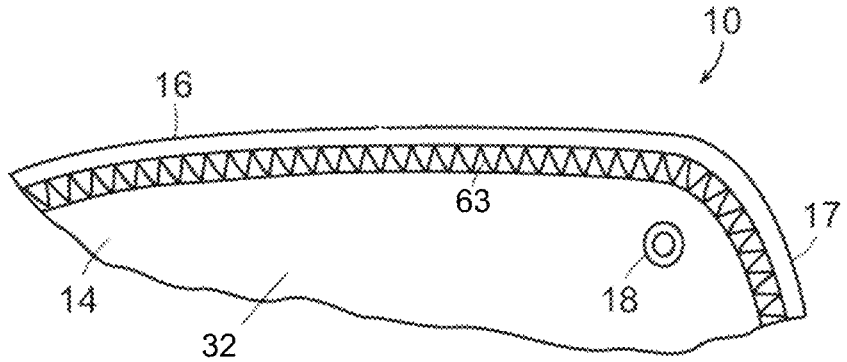
FIG. 5 shows a portion of an interior surface of the upper of the article of footwear of FIG. 1.

The stitching 35 and the stitching 24 are extensible and allow portions of the panels 31 and 32 secured by that stitching to stretch. This allows use of stretch canvas material in the upper 14 without unduly limiting the stretchability of that material in regions having the stitching 24 or the stitching 35. Moreover, the stitching 24 may have an appearance, on one side of the stitch, that is similar to that of the stitch type traditionally used in some types of shoes. In particular, each of the needle threads 61 and 62 appears similar to one side of a line of straight lock stitching. This allows a shoe to maintain an appearance, associated with shoes made without stretch canvas or other stretch materials, that consumer may demand. The looper thread 63 may be exposed on an interior surface of the upper 14, as can be seen in FIG. 5, which shows a portion of an interior surface of the upper 14.

Although examples of materials, stitch types and position, and other configurations are provided above, other materials, stitch types and/or positions, and/or other configurations may also or alternatively be used. For example, different types of stretch canvas may be used. Such other stretch canvas materials may have different amounts of stretchability in the weft direction. For example, prior to attachment to a liner or other material, a stretch canvas may have a weft direction stretchability of at least 25%, at least 50%, at least 75%, at least 100%, at least 150%, or more than 150%. A stretch canvas material may be stretchable in the warp direction (e.g., may have a stretchability of any of the previously-mentioned percentages) instead of the weft direction, and/or may have different weights, different combinations of fibers, and/or different weaves. Instead of being stretchable in the weft direction (or warp direction) and not stretchable in the warp (or weft) direction, stretch canvas used for an upper may have a first degree of stretchability in one of the weft or warp directions, and a second degree of stretchability, less than the first degree, in the other of the weft or warp directions. Stretch canvas may be arranged in an upper so that directions of maximum stretch and of no (or less than maximum) stretch are different from that shown as directions S and NS in FIG. 1.

Figure 6:
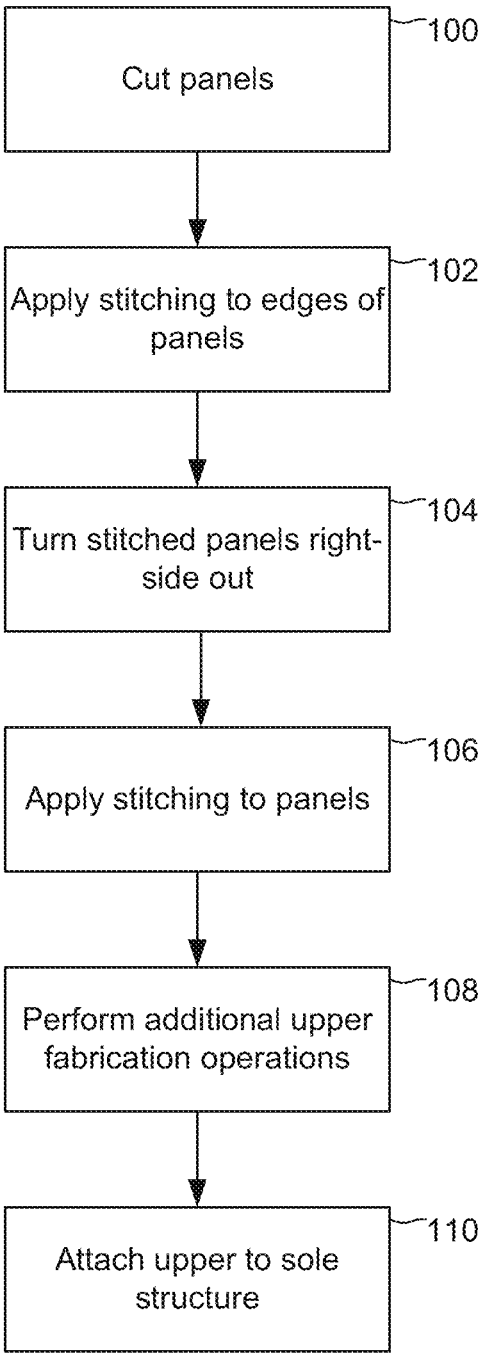
FIG. 6 is a flowchart showing steps of an example method for fabricating an upper and an article of footwear comprising that upper.

FIG. 6 is a flowchart showing steps of an example method for fabricating an upper and an article of footwear comprising that upper. In step 100, panels (e.g., the panels 31 and 32) may be cut from larger sheets of material. One of those panels may comprise stretchable canvas or another stretchable material, and may be used to form an exterior portion of an upper. One of those panels may comprise a material used to form a liner of the upper.

In step 102, stitching (e.g., the stitching 35) may be applied to edges of the panels. That stitching may be applied, for example, to secure those panel edges together. In step 104, the panels secured by the stitching of step 102 may be turned right side out. After turning the panels right side out, the stitched edges may be hidden between the remainder of the two panels.

In step 106, stitching (e.g., the stitching 24) may be applied to the panels that were turned right side out in step 104. This stitching may further secure the panels together. The stitching of step 106 may be in portions of the panels that are adjacent or otherwise proximate edges of the panels that will become edges of an ankle collar (e.g., the ankle collar 16) and/or a throat (e.g., the throat 17) in a completed upper. The stitching of step 106 may be applied so that one or more needle threads are on a surface that will become an exterior surface of the upper and so that one or more looper threads are on a surface that will become an interior surface of the upper.

In step 108, additional fabrication operations for the upper may be performed. Lace eyelets and/or ventilation holes may be added. A toe piece and/or a tongue may be attached. An Achilles region reinforcing strip may be attached. A strobel or other lasting element may be attached. In step 110, the upper from step 108 may be attached to a sole structure.

One or more of the steps of FIG. 6 may also be performed if the upper will not have a lining. For example, stitches (e.g., the stitching 24) may be applied to a panel similar to the panel 31, and with the panel 32 omitted.

For the avoidance of doubt, the present application includes the subject-matter described in the following numbered clauses:

1. An article, comprising a footwear upper, wherein the footwear upper comprises an elastically elongatable first panel.
2. The article of clause 1, wherein the first panel is elastically elongatable, along at least one direction across a surface of the panel, by at least 50%.
3. The article of clause 1 or clause 2, wherein the first panel comprises stretchable canvas.
4. The article of any of clauses 1-3, wherein the first panel comprises a woven material.
5. The article of any one of clauses 1-4, wherein the first panel comprises a woven material having a weft direction and a warp direction, wherein the first panel is elastically elongatable, in one of the weft direction or the warp direction, by a first percentage, and wherein the first percentage is at least 50%, and/or between 120% and 170%.

6. The article of clause 5, wherein the first panel is elastically elongatable, in the other of the weft direction or the warp direction, by no more than a second percentage, and wherein the second percentage is no more than 10%-30% of the first percentage, and/or wherein the first panel is elastically elongatable, in the other of the weft direction or the warp direction, by no more than 20%-35%.
7. The article of clause 5 or clause 6, wherein the first panel is elastically elongatable, in the other of the weft direction or the warp direction, by no more than 5%-10%.
8. The article of any of clauses 1-7, wherein the first panel forms exterior portions of the upper surrounding an ankle collar of the upper.
9. The article of any of clauses 1-8, wherein the first panel forms exterior portions of the upper surrounding a throat of the upper.
10. The article of any of clauses 1-9, further comprising first stitching comprising one or more needle threads penetrating the first panel and one or more looper threads coupled to the one or more needle threads, wherein the first stitching allows elongation of the first panel, in the at least one direction, by at least 50%.
11. The article of clause 10, wherein the first stitching extends along a first stitching path that is proximate to at least one of an ankle collar of the upper or a throat of the upper.
12. The article of clause 10 or clause 11, wherein the upper comprises a second panel, and wherein the first stitching secures the first panel to the second panel.
13. The article of any of clauses 10-12, wherein the second panel forms an interior surface of the upper.
14. The article of any of clauses 10-13, wherein the first stitching comprises cover stitching.
15. The article of clause 14, wherein the first stitching comprises double needle cover stitching.
16. The article of any of clauses 10-15, wherein the first stitching secures the first panel to a second panel.
17. The article of any of clauses 10-16, wherein the one or more needle threads extend across an exterior surface of the upper and the one or more looper threads extend across an interior surface of the upper.
18. The article of any of clauses 10-17, further comprising second stitching joining an edge of the first panel to an edge of a second panel, and wherein the second stitching allows elongation of the first panel, in the at least one direction, by at least 50%.
19. The article of clause 18, wherein the second stitching comprises overstitching.
20. The article of clause 18 or clause 19, wherein the second stitching extends along a second stitching path that is proximate to at least one of an ankle collar of the upper or a throat of the upper.
21. The article of any of clauses 10-13, wherein the first stitching comprises overstitching joining an edge of the first panel to an edge of a second panel, wherein the first panel forms at least a portion of an exterior surface of the upper and the second panel forms at least a portion of a lining of the upper.
22. The article of any of clauses 1-21, further comprising a sole structure, and wherein the upper is attached to the sole structure.
23. An article of footwear comprising an upper, wherein the upper comprises a first panel formed from stretchable canvas and forming exterior portions of the upper surrounding an ankle collar of the upper and a throat of the upper.
24. The article of clause 23, wherein the upper comprises first stitching that extends along a first stitching path that is proximate to at least one of the ankle collar or the throat, wherein the first stitching comprises double needle cover stitching.
25. The article of any of clauses 23-24, further comprising a sole structure, and wherein the upper is attached to the sole structure.
26. The article of any of clauses 23-25, wherein the first stitching path is proximate to the ankle collar.
27. The article of any of clauses 23-26, wherein the first stitching path is proximate to the throat.
28. The article of any of clauses 23-27, wherein the upper further comprises a second panel and overstitching joining an edge of the first panel to an edge of the second panel, wherein the second panel forms at least a portion of a lining of the upper.
29. The article of any of clauses 23-28, wherein one or more needle threads of the first stitching extend across an outer surface of the upper and one or more looper threads of the first stitching extend across an inner surface of the upper.
30. The article of any of clauses 23-29, wherein the stretchable canvas comprises a woven material having a weft direction and a warp direction, wherein the stretchable canvas is elastically elongatable, in one of the weft direction or the warp direction, by a first percentage, and wherein the first percentage is at least 50%.
31. The article of any of clauses 23-30, wherein the stretchable canvas is, in the other of the weft direction or the warp direction, elastically elongatable by no more than a second percentage, and wherein the second percentage is between 10%-30% of the first percentage.
32. A method comprising applying first stitching to at least a first panel, wherein the first panel is elastically elongatable, along at least one direction across a surface of the first panel, by at least 50%, and wherein the first stitching comprises one or more needle threads penetrating the first panel and one or more looper threads coupled to the one or more needle threads, and wherein the first stitching allows elongation of the first panel, in the at least one direction, by at least 50%.
33. The method of clause 32, further comprising forming an upper, from the first panel, with the first stitching extending along a first stitching path that is proximate to at least one of an ankle collar of the upper or a throat of the upper.
34. The method of clause 32 or clause 33, further comprising attaching the upper to a sole structure.
35. The method of any of clauses 32-34, wherein the first stitching comprises double needle cover stitching and secures the first panel to a second panel.
36. The method of any of clauses 32-35, further comprising joining an edge of the first panel to an edge of the second panel using overstitching.
37. The method of any of clauses 32-36, wherein the first panel comprises stretch canvas.

The foregoing description is not intended to be exhaustive or to limit embodiments of the present disclosure to the precise form described, and modifications and variations are possible in light of the above teachings or may be acquired from practice of various examples. The features discussed herein were chosen and described in order to explain the principles and the nature of various examples and their practical application to enable one skilled in the art to utilize the present disclosure with various modifications as are suited to the particular use contemplated. Any and all combinations, subcombinations, and permutations of features described herein are the within the scope of the disclosure.

The invention claimed is:

1. An article of footwear comprising:

a sole structure; and an upper attached to the sole structure, wherein the upper comprises:

a first panel, wherein the first panel comprises a stretchable canvas having a weft direction and a warp direction, wherein the first panel is elastically elongatable, in one of the weft direction or the warp direction, by a first percentage, and wherein the first percentage is between 120% and 170%;

wherein the stretchable canvas is, in the other of the weft direction or the warp direction, elastically elongatable by no more than a second percentage, and wherein the second percentage is between 10%-30% of the first percentage; and a first stitching comprising one or more needle threads penetrating the first panel and one or more looper threads coupled to the one or more needle threads, wherein the first stitching extends along a portion of a first stitching path that is proximate to and parallel to an ankle collar of the upper and another portion of the first stitching path that is proximate to and parallel to a throat of the upper, and wherein the first stitching allows elongation of the first panel, in at least one direction, by at least 50%;

wherein the one or more needle threads visibly extend across an exterior surface of the upper and the one or more looper threads extend across an interior surface of the upper.

2. The article of footwear of claim 1, wherein the first stitching comprises overstitching joining an edge of the first panel to an edge of a second panel, wherein the first panel forms at least a portion of an exterior surface of the upper and the second panel forms at least a portion of a lining of the upper.

3. The article of footwear of claim 1, wherein the first stitching comprises cover stitching.

4. The article of footwear of claim 1, wherein the first stitching comprises double needle cover stitching and secures the first panel to a second panel.

5. The article of footwear of claim 4, further comprising second stitching joining an edge of the first panel to an edge of the second panel, and wherein the second stitching allows elongation of the first panel, in the at least one direction, by at least 50%.

6. An article of footwear comprising:

a sole structure; and an upper attached to the sole structure, wherein the upper comprises:

a first panel formed from stretchable canvas and forming exterior portions of the upper surrounding an ankle collar of the upper and a throat of the upper; and a first stitching comprising one or more needle threads penetrating the first panel and one or more looper threads coupled to the one or more needle threads, the first stitching extends along a portion of a first stitching path that is proximate to and parallel to the ankle collar and another portion of the first stitching path that is proximate to and parallel to the throat, wherein the first stitching comprises double needle cover stitching, and wherein the first stitching allows elongation of the first panel, in at least one direction, by at least 50%;

wherein the stretchable canvas comprises a woven material having a weft direction and a warp direction, wherein the stretchable canvas is elastically elongatable, in one of the weft direction or the warp direction, by a first percentage, and wherein the first percentage is between 120% and 170%; wherein the stretchable canvas is, in the other of the weft direction or the warp direction, elastically elongatable by no more than a second percentage, and wherein the second percentage is between 10%-30% of the first percentage;

wherein one or more needle threads of the first stitching visibly extend across an outer surface of the upper and one or more looper threads of the first stitching extend across an inner surface of the upper.

7. The article of footwear of claim 6, wherein the upper further comprises a second panel and overstitching joining an edge of the first panel to an edge of the second panel, wherein the second panel forms at least a portion of a lining of the upper.

* * * * *